US005607295A

United States Patent [19]

Khemarangsan

[11] Patent Number: 5,607,295

[45] Date of Patent: Mar. 4, 1997

[54] SAFETY LOCK CIGARETTE LIGHTER

[75] Inventor: Decha Khemarangsan, Samutsakorn, Thailand

[73] Assignee: Thai Merry Co., Ltd., Samutsakorn, Thailand

[21] Appl. No.: 524,328

[22] Filed: Sep. 6, 1995

[51] Int. Cl.[6] ..... F23D 11/36

[52] U.S. Cl. ..... 431/153; 431/277

[58] Field of Search ..... 431/153, 277; 222/153

[56] References Cited

U.S. PATENT DOCUMENTS

| | | | |
|---|---|---|---|
| 4,784,602 | 11/1988 | Nitta | 431/153 |
| 4,786,248 | 11/1988 | Nitta | 431/153 |
| 4,830,603 | 5/1989 | Cirami | 431/153 |
| 4,850,854 | 7/1989 | Buck | 431/143 |
| 5,002,482 | 3/1991 | Fairbanks et al. | 431/153 |
| 5,074,781 | 12/1991 | Fujita | 431/153 |
| 5,120,215 | 6/1992 | Amoros Nollas | 431/153 |
| 5,215,458 | 6/1993 | Cirami | 431/153 |
| 5,224,854 | 7/1993 | Ansquer | 431/153 |

*Primary Examiner*—Carl D. Price
*Attorney, Agent, or Firm*—Burgess, Ryan and Wayne

[57] ABSTRACT

A portable lighter for burning a combustible fuel having a locking means which must be arranged in an operating position for the lighter to be operated to produce a flame. The lighter automatically returns to a non-operating condition after a striking or a single operation. The safety mechanism is a rotatable and axially moveable lock means with a projection which engages an operating member to prevent the operating member from opening the valve to emit the combustible gaseous material. The lock means is axially and rotatably biased to cause the operating member to return to a position in which the lighter is not operable after a striking operation.

13 Claims, 4 Drawing Sheets

SAFETY LOCK CIGARETTE LIGHTER

FIELD OF THE INVENTION

This invention relates generally to lighters which consume a fuel such as butane by converting the fuel under pressure to a gaseous state and thereafter burning the fuel. Particularly, the invention relates to a disposable butane cigarette lighter having a safety mechanism which prevents a valve actuator from being depressed and in turn prevents a valve nozzle from expelling butane thereby rendering operation of lighter by young children difficult.

BACKGROUND OF THE INVENTION

Recently, manufacturers of lighters and the consumers have become aware of dangers associated with lighters inadvertently becoming operable. More particularly, there is great concern by manufacturers of lighters, of fires being started by children playing with lighters leading unfortunately to tragic results.

To prevent the inadvertent disasters which can occur from children playing with lighters, attempts have been made to make lighters difficult for children to operate. However, in making the lighters difficult for children to operate, care must be taken so that the lighters do not become so difficult for adults to operate that adults are not willing to purchase the lighters.

The currently preferred method for making lighters difficult for children to operate is to provide a lighter which must be set to be operable and returns to an inoperable condition after a single use or striking of the lighter.

RELATED ART

U.S. Pat. No. 4,784,602 discloses a gas lighter equipped with a safety lock. However, the safety lock must be returned to the locking position manually after a strike or use of the lighter. U.S. Pat. No. 4,786,248 also discloses a gas lighter equipped with a safety lock. However, the safety lock must be moved to the lock position manually after each use of the lighter.

U.S. Pat. No. 4,850,854 discloses a different approach for manufacturing a child resistant cigarette lighter. The cigarette lighter disclosed in this patent provides a cigarette lighter with a flame deep inside the lighter and an aperture through which the cigarette must be inserted to reach the flame provided by the lighter. The lighter is safe in that there is no flame which projects from the lighter. The combustible gas is burned inside the lighter. However, this type of device is bulky due to the extra casing and space required to provide a flame inside of the lighter.

U.S. Pat. No. 5,002,482 discloses a lighter of the type claimed herein in which the lighter must be set to an operating position and after the lighter is struck, the lighter is automatically returned to an inoperable condition. The heart of the device is a split resilient ring having fingers. The split resilient ring is moved from a locking position and after the lighter is struck, the resilient ring with he fingers returns the lighter to an inoperable condition.

Another locking type cigarette lighter is disclosed in U.S. Pat. No. 5,074,781 which provides a spring biased rotatable locking means. The locking feature is a rotatable piece with a raised portion which interferes with depression of the operating member. When the rotating piece is moved to the operating position, the raised portion is removed from the path of the operating member and the operating member can be depressed and the lighter struck. The lighter is made inoperable by the blocking of a projection on the operating member by the raised portion to prevent it from being moved downwardly and thereby opening the gas valve.

The present invention is an improvement over the known lighters.

SUMMARY OF THE INVENTION

It is the principal object of the present invention to provide a cigarette lighter having a simple structure which can reliably prevent an unintentional lighting operation. According to the present invention, a flame producing lighter is provided comprising:

- a housing comprising a reservoir containing a combustible medium under pressure;
- valve means in communication with the combustible medium in the reservoir, comprising an operating member arranged for actuation between a normally closed position which prevents exit of the combustible medium from the reservoir, and an open position which permits exit of the combustible medium from the reservoir through the valve means;
- means for producing a spark at a location proximate to a combustible medium exit opening of the valve means to cause ignition of the combustible medium;
- an axially movable and rotatable lock means rotatable about an axis of rotation to a first position to inhibit movement of the operating member and to a second position to permit movement of the operating member, the lock means having a first projection, to engage the operating member, arranged on an upper surface at a point between the axis of rotation and an edge and a second projection, arranged on a surface opposite to the upper surface on the axis of rotation;
- a lock portion with means for engaging the lock means when the lock means is in the second position;
- a spring means for applying an axially upward bias and a rotation bias to the lock means, the axially upward bias to cause the lock means to engage the lock portion when the lock means is in the second position and the rotation bias to cause the lock means to rotate to the first position when the lock means is not engaged with the lock portion.

In an embodiment of the invention, the operating member has a sloping surface with a recess at the operating position (second position) to prevent the first projection from sliding down the slope to the operating prevention position (first position). Alternately, the operating member may have only a sloping surface to contact the first projection but the lock portion has an indentation into which the moving member, of the axially moveable and rotatable lock means, is engaged by the spring moving the locking means in an axial direction to engage the shoulder of the indentation when it is in the second position.

Upon operation of the lighter, the operating member, which is engaged with the lock means, is depressed. The depression of the operating member moves the locking means axially against the axial bias of the spring means, and out of engagement with the indentation of the lock portion, upon release of the force, the axially moveable and rotatable member is moved to the first position, in which operation of the operating means is prevented by the rotational bias of the spring means.

The sloping surface of the operating member can be a groove in the underface of the operating member arranged to engage the first projection on the axially moveable and rotatable lock means.

The operating member can be placed in and maintained in an operable condition by axial movement of the lock means so that the first projection rests in a notch in the sloping surface of the operating member in contact with the first projection.

In an alternate embodiment, the axially moveable and rotatable lock means comprises a lever means for ease of rotation, which lever means projects from the lighter body through a slot with a notch in the lock portion at the second position where the lighter is operable. The axial force of the spring means moves the lock means in an axial direction to cause the lever means to engage the notch, in the lock position and the lock means is prevented from returning to the first position by the rotational bias of the spring means causing the lever means to bear against the side of the notch. In some cases, it is preferred to utilize a notch in the sloping surface of the operating member and in addition, the notch in the slot of the body portion in which the lever means moves to rotate the lock means.

When the lighter is operated, the operating member is depressed along with rotation of the striking wheel, the valve is opened, the gas is permitted to escape and the sparks from the striking wheel ignite a flame. The downward movement of the operating member places pressure on the first projection which moves the lock means in a downward axial direction. Upon release of the pressure from the operating member, the bias force of the spring moves the lock means to a position in which the lighter is inoperable.

DETAILED DESCRIPTION OF THE INVENTION

Figure 1:
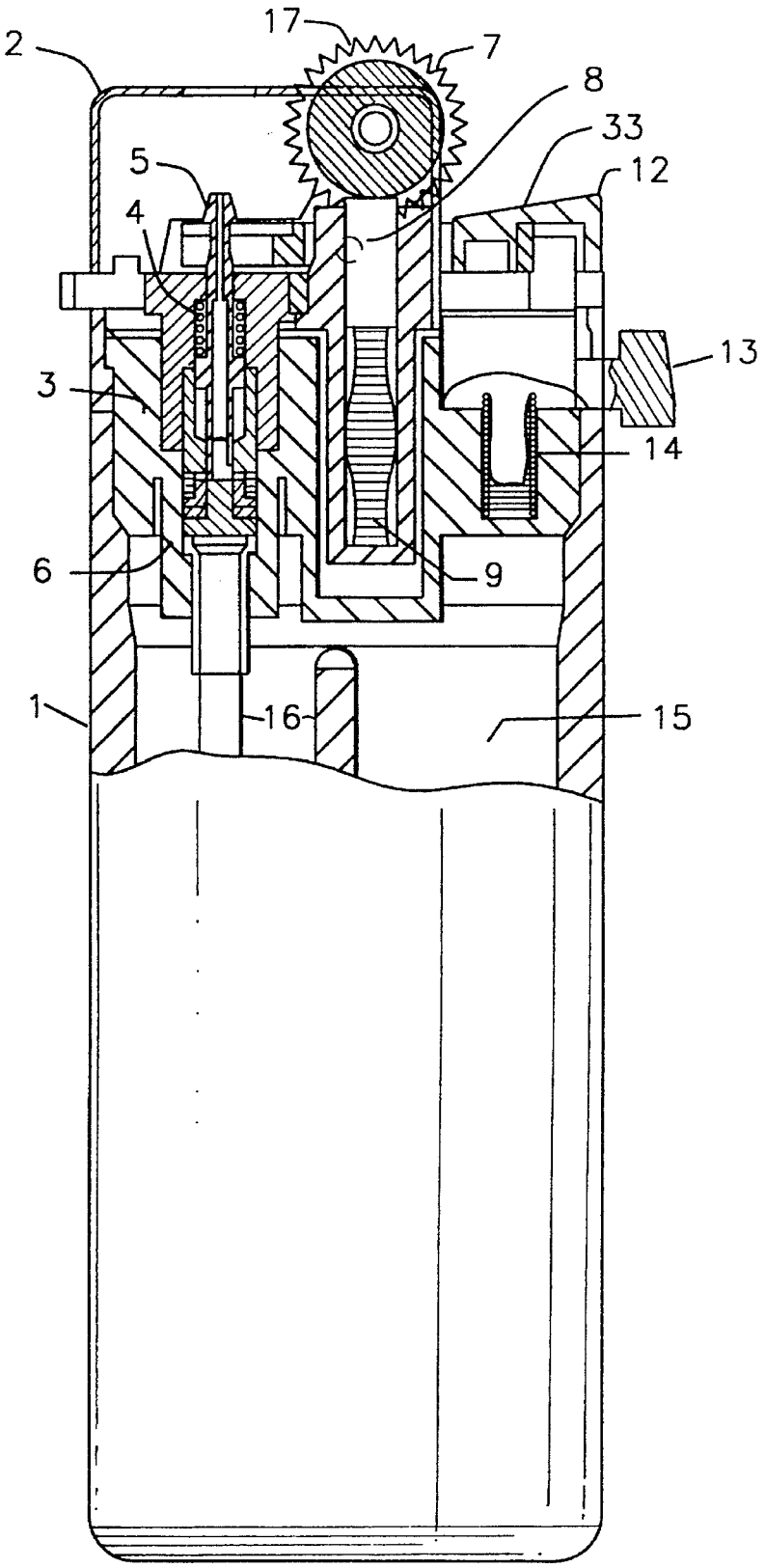
FIG. 1 is an elevation view from a side in partial section of a lighter of the invention.

FIG. 1 shows a lighter body 1 having a reservoir means 15 for storing a liquified combustible gas and a wick means 16 for introducing the liquified combustible material to the valve means 3. The valve means 3 comprises a valve seat apparatus 6 and a nozzle 5 with a spring means 4 biasing the valve means in the closed position. In operation, the valve means 3 is opened against the biasing force of the spring 4 by downward pressure on the top surface 33 of the operating member 12. When the pressure on the top surface 33 of the operating member 12 is removed, the force of the biasing spring 4 closes the valve means 3 and the combustible gas is stopped from flowing from the nozzle 5.

Simultaneously with the pressing of the operating member 12, the striking means operating wheel 7 is rotated and the striking wheel 17 is rubbed against the flint 8 to produce sparks in the area of the valve nozzle 5. The flint 8 is biased against the striking wheel 17 by means of spring 9.

FIG. 1 also illustrates the lock means 13 and the spring means 14 which axially and rotationally biases the lock means 13.

In addition, FIG. 1 shows the wind shield 2 which shields the flame of the combustible gas issuing from the nozzle means 5.

Figure 2:
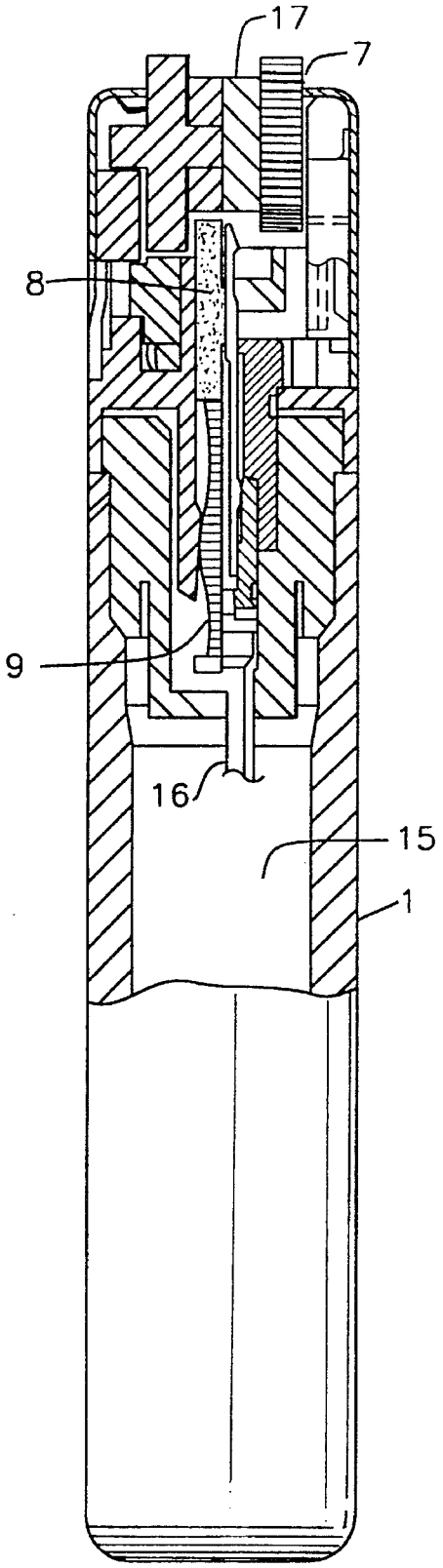
FIG. 2 is an elevation view in partial section from the right side of the lighter of FIG. 1.

FIG. 2 is an elevational view in partial section from the right of the lighter of FIG. 1. FIG. 2 illustrates the striking means operating wheel 7 in relation to the striking wheel 17 and the spring 9 which biases the flint 8 against the striking wheel 17.

The lighter 1 with the wind shield 2, valve means 5 operable by an operating means 12 with a striking wheel 17 and striking means operating wheel 7 which moves the striking wheel against the flint 8 and spring means 9 for biasing the flint against the striking wheel, are common to many flame lighters and are well known in the art. The lighters generally have a reservoir 15 for storing the liquefied combustible material and a wick means for carrying the liquefied combustible material to the valve means 3. The present invention differs from the prior art in the structure of the operating member 12 and the lock means 13.

As one skilled in the art would understand, an igniting spark can be supplied to an area adjacent to the valve outlet means 5 by means other than striking a flint. Piezoelectric crystal means or other striking means known in the art can be used in the lighter of the present invention. A flint means is illustrated but the structure is not limited thereto. Any means which is known for providing an ignition means adjacent to the outlet of nozzle means 5 can be utilized in the lighter of the present invention.

The lighter of the present invention provides a locking means 13 which operates in cooperation with the operating member 12 and lock portion 41 to prevent downward movement of the operating member 12 when the lock means 13 is in a first position and to permit downward movement of the operating member 12 when the lock means is in a second position.

The lighter is arranged so that the operating member 12 and the lock means 13 operate in cooperation with each other to prevent inadvertent operation of the operating member. The lighter of the present invention requires a purposeful setting of the lock means 13 to the second position to permit downward movement of the operating member 12 in response to pressure exerted on the top surface 33 of the operating member 12.

FIGS. 3, 4, 5, 6, 7 and 10 set forth in detail the structure of the operating member 12 and the lock means 13.

Figure 3:
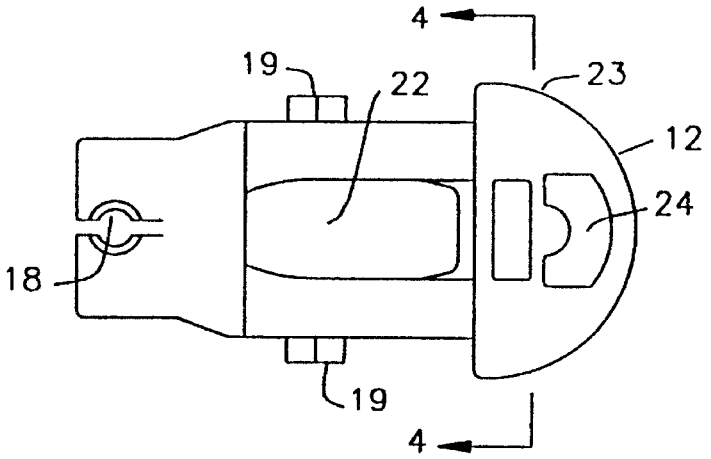
FIG. 3 is a plan view from the bottom of the operating member.

FIG. 3 is a plan view from the bottom of an embodiment of the operating member 12. The operating member 12 is a planar member having pivoting means 19 for mounting the operating member 12 on the lighter 1. An open space 22 in the operating member 12 permits the operating member 12 to surround the portion of the lighter supporting the striking wheel operating member 7 and the flint 8. The operating member 12 is rotatably mounted on the lighter body 1 by pins 19 which extend from the edges of the operating member. At the lefthand portion of FIG. 3, the operating member 12 has gripping means 18 for surrounding the nozzle 5 of valve means 3 to move the valve means in an upward direction in response to a downward movement of the end 23 of the operating member 12.

Figure 4:
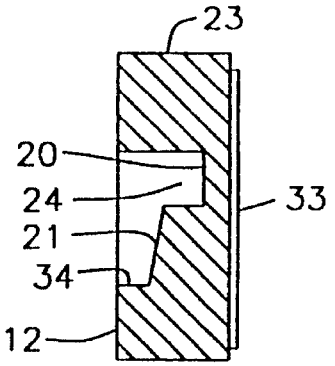
FIG. 4 is a view in section of the operating member along the line A—A.
Figure 10:
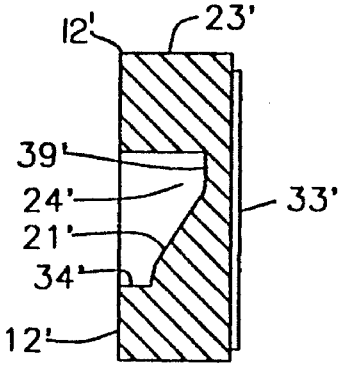
FIG. 10 is a view in section of an alternate embodiment of the operating member of FIG. 3.

As shown in FIG. 3, the operating member 12 has a slot 24 formed in the lower surface. A cross-section of an embodiment of the slot 24 is shown in FIG. 4. A cross-section of an alternate embodiment of the slot 24 is shown in FIG. 10.

As shown in FIG. 4, the slot 24 in operating member 12 is formed on the lower surface opposite to the surface 33 for applying pressure to the operating member. As shown in FIG. 4, the slot 24 comprises a stop edge 34, a sloping surface 21 and a recess 20.

In operation, in the first position, the projection 28 of lock means 13 rests against stop edge 34. In the second position, the projection 28 of lock means 13 is engaged with recess 20 of slot 24. In the embodiment of operating member 12' shown in FIG. 10, in the second position, the projection 28' rests against the section 39' of the slot 24' in operating member 12'. The slot 24' in FIG. 10 does not have the recess 20 of the embodiment shown in FIG. 4 and therefore must rely upon engagement of the arm 40 of operating lever 32 with the edge of the notch 35 in the slot 36 of the lock portion 41 in the lighter body.

Figure 5:
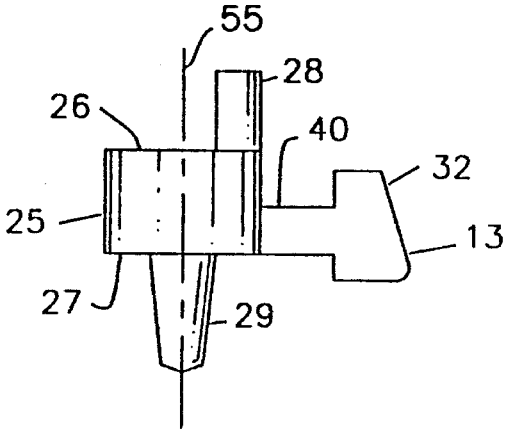
FIG. 5 is an elevation view of the lock means.
Figure 6:
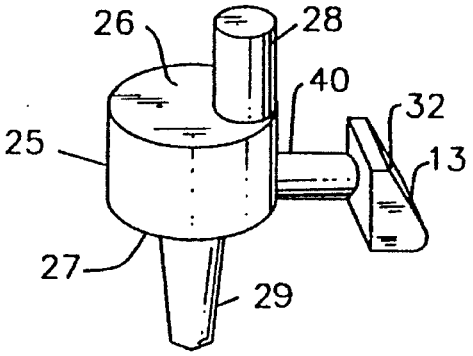
FIG. 6 is an isometric view of the lock means.

FIGS. 5 and 6 illustrate an embodiment of lock means 13. The lock means 13 has an operating lever 32 connected to the body 25 by arm 40, for rotating the lock means 13 about the axial projection 29. The arm 40 can have a square cross section, a round cross section or a wedge shaped cross section with the shorter side of the wedge facing the first position to facilitate return of the lock means to the first position. A round or wegde shape is preferred as return of the lock means to the first position is facilitated since the arm 40 must be moved a shorter distance to permit the bias force provided by the spring means to return the lock means to the first position. The lock means 13 rotates about the axis 35 in a recess 30 in the lighter body 1.

As shown in FIGS. 5 and 6, lock means 13 comprises a projection 28 which projects above the upper surface 26 of the body 25 of lock means 13. The lock means 13 has a lower surface 27 of the body 25 from which a projection 29 extends along the axis 55. In the embodiment shown, a spring means 14 engages the projection 29 and applies a rotational bias to the lock means 13 in the direction of the first position. The spring means provides a sufficient amount of rotational bias to lock means 13 to maintain the lock means 13 in the first position. In addition, the spring means 14 biases the lock means 13 in an axially upward direction in the lighter as shown in FIGS. 8 and 9.

Figure 7:
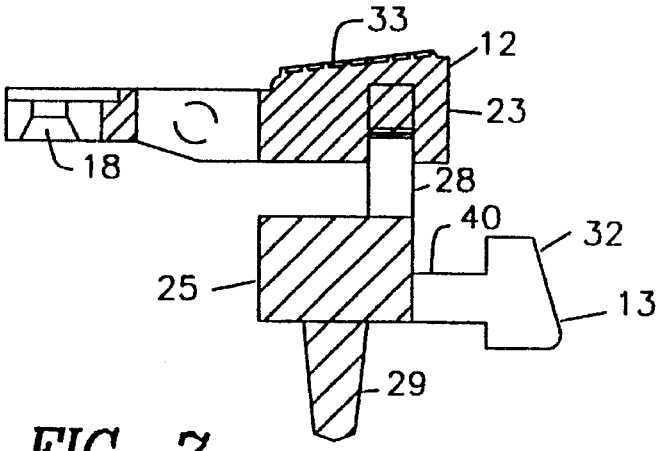
FIG. 7 is a view of engagement between the operating member and the lock means in the first position.
Figure 8:
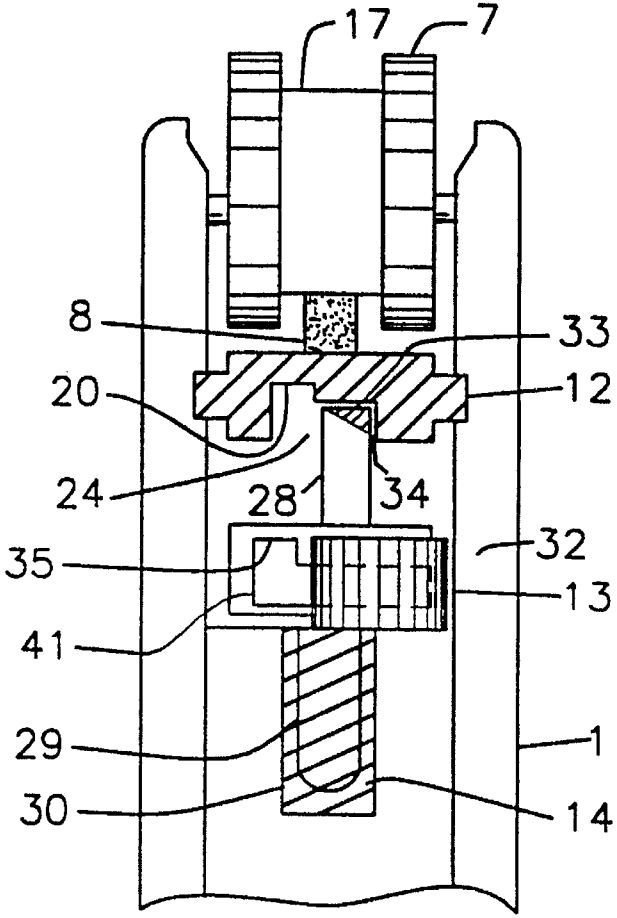
FIG. 8 is a simplified view in partial section of a portion of the lighter, illustrating engagement of the lock means, lock portion and operating member in the first position.

FIG. 8 shows the lighter 1 with the lock means 13 in the first position. The engagement of the operating member 12 with the lock means 13 in the first position is shown in FIG. 7. As shown in FIG. 7, the projection 28 of lock means 13 is engaged with the slot 24 at its most shallow section. As shown in FIG. 8, the projection 28 bears against the stop edge 34 of the slot 24 in operating member 12.

Figure 9:
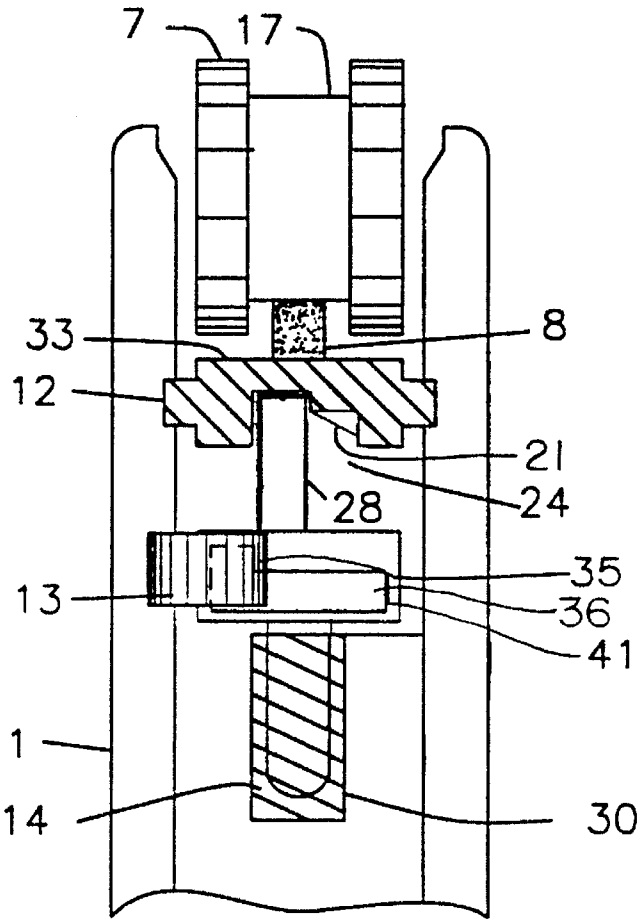
FIG. 9 is a simplified view in partial section of a portion of the lighter, illustrating engagement of the lock means, lock portion and operating member in the second position.

FIG. 9 illustrates the relation between the operating member 12, the lock means 13 and the lock portion 41 in the second position. As shown in FIG. 9, the lever 32 of lock means 13 has been moved to the left. The arm 40 of lock means 13 has engaged the notch 35 in the slot 36 of the lock portion 41. The arm 40 of the lever 32 is biased upwardly by the spring means 14 to cause engagement of the arm 40 with the notch 35 in lock portion 41. In addition, in the second position, the projection 28 of the lock means 13 engages the recess 20 in the slot 24 of operating member 12.

In operation, when one rotates the striking wheel operating member 7 in a clockwise direction in FIG. 1, the finger then proceeds to apply pressure to the upper surface 33 of operating member 12. The pressure applied to the upper surface 33 of operating member 12 causes the operating member 12 to press downwardly against the projection 28 and causes the lock means 13 to move in an axially downward direction and cause the arm 40 of lever 32 to become disengaged from the notch 35 in slot 36 of lock portion 41.

When the flame is to be extinguished, the pressure on the upper surface 33 of operating member 12 is removed. Upon removal of the pressure from the upper surface 33, the biasing spring 4 of valve means 3 causes the valve means 3 to close and move the end 23 of operating member 12 in an upward direction. The movement of the end 23 of operating member 12 in an upward direction disengages the projection 28 from the recess 20 in slot 24 of operating member 12.

Since the downward pressure on surface 33 caused the arm 40 of lever 32 to disengage from the notch 35 in the lock portion 41 and the upward movement of the operating member 12 disengages the recess 20 from the projection 28, the rotational bias provided by spring means 14 returns the lock means to the first position. With the lock means 13 in the first position, the operating member 12 is prevented from moving downwardly to release the combustible material through the valve means 3.

In an alternate embodiment, the operating member 12' has a slot 24' in the configuration shown in FIG. 10. In the operating position, the projection 28 does not engage a recess 20 but rests on a portion 39' of the slot 29' of the sloping surface 21'. In a configuration which utilizes the slot means 24 shown in FIG. 10, the lock means 13 is maintained in the second position in which the lighter can be operated by engagement of the arm 40' of lever 32' with the edge of the notch 35 in slot 36 of lock portion 41. 0n operation of the lighter, the operating member 12' is moved in a downward direction which forces the arm 40 of lever 32 from engagement with the notch 35 in slot 36 of lock portion 41.

Upon release of the pressure from the upper surface of operating member 12', the spring 4 causes the end 23' of operating member 12' to move upwardly and the rotational bias provided to the lock means 13 by spring 14 causes the lock means to rotate to the first position and rest against the edge 34' of the slot 24' with the sloping surface 21'.

It is clear that in the present invention, before the lighter is made operable, the lever 32 of lock means 13 must be moved from the first to the second position to place the lighter in an operable condition. As shown in the drawings, the first position is the position in which the lever 32 of lock means 13 is at the right and the second position is with the lever 32 to the left and the arm 40 is engaged with the notch 35 of slot 36 in lock portion 41. It would be clear to one skilled in the art that the lighter could be arranged so that the first position would require that the lever 32 of lock means 13 is at the left in the first position and at the right in the second position. This is a matter of design and would be well understood by one skilled in the art.

As can be seen from the foregoing description of the invention, a positive act is required to place the lighter in an operable condition. In addition, after a striking operation or a lighting operation, the lighter is automatically placed in a non-unoperating condition in which the operating member 12 cannot be moved in a direction to open the valve means 3 to permit the combustible gas to flow from the valve means.

The lighter of the invention is simple to manufacture and provides a degree of safety in that operation of the lighter is more complex and requires the positive step of moving the lock means from a first position to a second position.

What is claimed is:

1. A flame producing lighter which comprises:

a housing comprising a reservoir containing a combustible medium under pressure;

valve means comprising an operating member, having a slot in a lower surface thereof, the operating member being arranged for actuation between a normally closed position which prevents exit of the combustible medium from the reservoir, and an open position which permits exit of the combustible medium from the reservoir through the valve means, the valve means being biased in the normally closed position;

means for producing a spark at a location proximate to a combustible medium exit opening of the valve means to cause ignition of the combustible medium;

an axially moveable and rotatable lock means, rotatable about an axis of rotation to a first position to inhibit movement of the operating member and to a second position to permit movement of the operating member, the lock means having a first projection, which engages the slot in the operating member, the first projection being arranged on an upper surface of the lock means at a point between the axis of rotation and an edge and a second projection arranged on a surface opposite to the upper surface on the axis of rotation, the lock means having an operating means for aid in rotation of the lock means from the first position to the second position;

a lock portion for engaging the lock means when the lock means is in the second position;

a spring means for applying an axially upward bias and a rotational bias to the lock means whereby the axially upward bias causes the lock means to engage the lock portion when the lock means is in the second position, and the rotational bias biases the lock means in the first position when the lock means is not engaged with the lock portion.

2. A lighter of claim 1 wherein the slot in the operating member engaging the projection on the upper surface of the lock means comprises a recess for engagement with the projection in the second position.

3. A lighter of claim 2 wherein the recess in the slot in the operating member comprises the lock portion.

4. A lighter of claim 3 wherein the lock portion means for engaging the lock means comprises a slot with a notch in the lighter body which permits the lock means to move axially upward at the second position.

5. A lighter of claim 3 wherein the spring means comprises a single coil spring.

6. A lighter of claim 2 wherein the lock portion means for engaging the lock means comprises a slot with a notch in the lighter body which permits the lock means to move axially upward at the second position.

7. A lighter of claim 2 wherein the spring means comprises a single coil spring.

8. A lighter of claim 2 wherein the slot in the operating member comprises a sloping surface with a most shallow portion of the slot for engagement with the projection in the first position and deepest portion of the slot for engagement with the projection in the second position.

9. A lighter of claim 8 wherein the lock portion means for engaging the lock means comprises a slot with a notch in the lighter body which permits the lock means to move axially upward at the second position.

10. A lighter of claim 8 wherein the spring means comprises a single coil spring.

11. A lighter of claim 1 wherein the spring biasing means comprises a single coil spring.

12. A lighter of claim 11 wherein the lock portion means for engaging the lock means comprises a slot with a notch in the lighter body which permits the lock means to move axially upward at the second position.

13. A lighter of claim 1 wherein the lock portion means for engaging the lock means comprises a slot with a notch in the lighter body which permits the lock means to move axially upward at the second position.

* * * * *